US005790672A

United States Patent [19]

Klostermeier

[11] Patent Number: 5,790,672

[45] Date of Patent: Aug. 4, 1998

[54] IN EAR HEARING AID

[75] Inventor: Arend Klostermeier, Kirchlengern, Germany

[73] Assignee: AS Audio Service GmbH, Herford, Germany

[21] Appl. No.: 925,150

[22] Filed: Sep. 8, 1997

[30] Foreign Application Priority Data

Sep. 11, 1996 [DE] Germany ..... 196 36 800.6

[51] Int. Cl.[6] ..... H04R 25/00

[52] U.S. Cl. ..... 381/68.6; 381/69; 381/69.2

[58] Field of Search ..... 381/23.1, 68, 68.2, 381/68.3, 68.4, 68.5, 68.6, 68.7, 69, 69.2

[56] References Cited

U.S. PATENT DOCUMENTS 4,634,815 1/1987 Marquis ..... 381/68.6

4,739,512 4/1988 Hartl et al. ..... 381/68.6

FOREIGN PATENT DOCUMENTS

3406971 A1 8/1985 Germany .

35 05 390 C2 8/1985 Germany .

*Primary Examiner*—Huyen Le

*Attorney, Agent, or Firm*—Pollock, Vande Sande & Priddy

[57] ABSTRACT

An in-ear hearing aid device including a cup fitted into the auditory canal, and having an earphone, an amplifier, and a microphone arranged therein, the device further including a battery chamber, an adjuster and a front plate, the front plate being mounted on a locking plate firmly connected to the cup, and being lockable and rotatable around the axis of rotation revolving on the locking plate that runs vertical to the locking plate, the front plate having a closed outer surface that is only interrupted by a sound inlet opening.

10 Claims, 1 Drawing Sheet

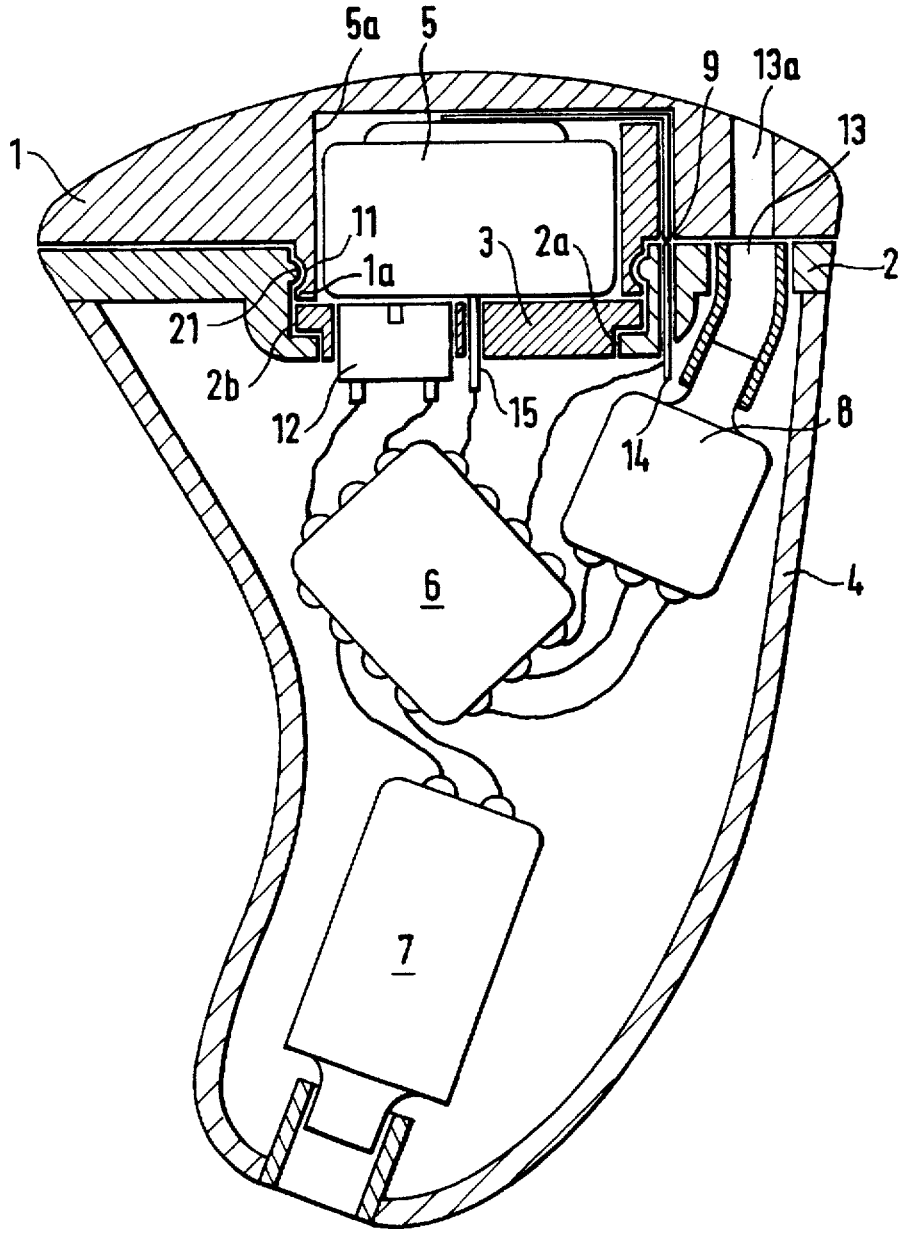
5a
5
9
13a
13
1
11
3
2a
2
1a
21
2b
12
15
14
8
6
4
7

IN EAR HEARING AID

FIELD OF THE INVENTION

The present invention relates to an in-ear hearing aid with cup fitted into the auditory canal in which cup there are an earphone, an amplifier and a microphone, the device also including a battery chamber, an adjuster and a front plate.

BACKGROUND ART

In the case of known hearing aids of this kind (DE 35 05 390 C2), which are designated as "custom-made devices," the front plate into which the battery compartment, volume control, etc. are built, is tightly secured to the cup fitted into the auditory canal. In the event repairs have to be undertaken inside the cup, the front plate must be separated from the cup and, after the repair has been completed, they must be secured to each other again. A further disadvantage of these hearing aids is the fact that they are aesthetically unattractive because too many components are visible on the inner surface of the ear.

In addition, so-called "fully modular devices" are known, for example, from DE 34 06 971 A1, in which all the operating parts are accommodated in a prefabricated housing. These hearing devices can be secured by means of otoplastic and can therefore be very easily separated again. These fully modular devices, however, have the distinct disadvantage that they also do not look very good in the ear because too many components are visible.

Moreover, so-called "semi-modular hearing aids" are known in which an outer surrounding plate is firmly connected to the cup fitted into the auditory canal. The module containing all the essential components, especially the battery compartment and the amplifier, can be secured to the plate. In these devices the module can be easily removed. However, these devices have the distinct disadvantage that many elements that disturb the aesthetic appearance can be seen on the side of the modular plate facing outwardly as, for example, the battery compartment, the amplifier, and other service elements.

SUMMARY OF THE INVENTION

Proceeding from this state-of-the-art, the purpose of this invention is to create an in-ear hearing aid characterized in that it provides an aesthetically pleasing exterior of the visible front side in its final fitted state, as well as ensuring good accessibility to the various components, even inside the cup, without need to make separation cuts in the process.

The solution of this problem is achieved by means of the special features of the present invention. Thus, in the present invention an in-ear hearing aid device includes a cup fitted into the auditory canal, and having an earphone, an amplifier, and a microphone arranged therein. The device further includes a battery chamber, an adjuster and a front plate, the front plate being mounted on a locking plate firmly connected to the cup, and being lockable, and also rotatable around the axis of rotation revolving on the locking plate that runs vertical to the locking plate. The front plate has a closed outer surface that is only interrupted by a sound inlet opening.

The securable front plate makes it possible to create an aesthetically pleasing exterior, while retaining at the same time good accessibility to the various components. The securable front plate can be designed without eye-disturbing components or components protruding beyond the designed contour. Furthermore, operation is quite simple since the entire front plate is easily available as target area.

A preferred embodiment of the invention will be described below in detail with reference to the accompanying drawing.

BRIEF DESCRIPTION OF THE DRAWING(S)

The FIGURE shows a longitudinal section through an in-ear hearing aid of the present invention.

DETAILED DESCRIPTION OF THE PREFERRED EMBODIMENTS

In a preferred embodiment shown, locking plate 2 is secured around the edge to cup 4 fitted into the auditory canal. Locking plate 2 has a central through opening **2*a*, which on a whole is designed in circular cylindrical form. Through opening 2*a* forms a collar, on which appropriately designed portion 2*b* of modular plate 3** rests on the end of the through opening facing the cup interior.

The usual functional parts, namely, an earphone 7, an amplifier 6, and a microphone 8 are located inside the cup. Modular plate 3 contains an adjuster, which is a trimmer 12 in the design example shown, but could also be a programing jack, for example.

Plus contact 15, adjacent battery 5, extends through modular plate 3. The minus contact on battery 5 is designated as 14. Micro-tubing 13 extends from the microphone to through opening **13*a* in front plate 1**.

Front plate 1 has a central circular cylindrical battery chamber. Front plate 1 is opposite locking plate 2, and can rotate around a central vertical axis (not shown in the FIGURE). This axis of rotation runs through plus contact 15. Rotation of front plate 1 results in an interruption of minus contact 14 at the separation point.

Front plate 1 has a collar **1*a* that secures modular plate 3 in its installed position. Collar 1*a* has notch 11 on its periphery; it corresponds to locking stud 21 on the locking plate. The front plate can be locked and released by means of cooperation of the locking notch 11 and locking stud 21**.

I claim:

1. An in-ear hearing aid device including a cup fitted into the auditory canal, and having an earphone, an amplifier, and a microphone arranged therein, said device further including a battery chamber, an adjuster and a front plate, said front plate being mounted on a locking plate firmly connected to said cup, and being lockable and rotatable around the axis of rotation revolving on the locking plate that runs vertical to the locking plate, said front plate having a closed outer surface that is only interrupted by a sound inlet opening.

2. A hearing aid device according to claim 1, wherein said front plate houses a battery chamber open to said cup, the battery chamber has a bottom level to the front side of the cup and is closed by a modular plate from the inner space of cup, said modular plate being removable through a through opening in the locking plate.

3. A hearing aid device according to claim 2, wherein said modular plate is secured by means of a collar of said front plate, facing in the direction of the cup's interior.

4. An in-ear hearing aid according to claim 3, wherein said collar is of circular cylindrical design and has a locking notch on its outer circumference, corresponding to a rib or stud located on the opposite inner wall of a through opening of said locking plate.

5. A hearing aid device according to claim 1, wherein a modular plate is secured by means of a collar of said front plate, said modular plate facing in the direction of the cup interior.

6. A hearing aid device according to claim 5, wherein said collar is of circular cylindrical design and has a locking notch on its outer circumference, cooperating with a rib or stud located on the opposite inner wall of a through opening in said locking plate.

7. A hearing aid device according to claim 1 wherein the front plate pivotally mounted on said locking plate is the operating element of an off-on switch.

8. A hearing aid device according to claim 1 wherein said adjuster is situated in the modular plate.

9. A hearing aid device according to claim 8 wherein said adjuster is a trimmer.

10. A hearing aid device according to claim 8 wherein said adjuster is a programming jack.

* * * * *